US005259274A

United States Patent [19]

Hreha

[11] Patent Number: 5,259,274

[45] Date of Patent: Nov. 9, 1993

[54] HAND TOOL WITH INTERNALLY REINFORCED JACKETED HANDLE

[75] Inventor: Kenneth W. Hreha, Tullahoma, Tenn.

[73] Assignee: The Stanley Works, New Britain, Conn.

[21] Appl. No.: 920,761

[22] Filed: Jul. 28, 1992

[51] Int. Cl.[5] ..... B25D 1/00

[52] U.S. Cl. ..... 81/20; 81/22

[58] Field of Search ..... 81/20, 22, 27, 489, 81/492; 30/340, 342, 343, 344, 308.1; 403/265-269

[56] References Cited

U.S. PATENT DOCUMENTS 1,449,677 3/1923 Jones ..... 81/20 X
3,320,985 5/1967 Maguire et al. ..... 81/22
3,877,826 4/1975 Shepherd, Jr. et al. ..... 81/20 X
4,085,784 4/1978 Fish ..... 81/20
4,334,563 6/1982 Epel et al. ..... 30/308.1
5,056,381 10/1991 Carmein ..... 81/20 X

FOREIGN PATENT DOCUMENTS 2495986 6/1982 France ..... 81/20

*Primary Examiner*—D. S. Meislin
*Attorney, Agent, or Firm*—Samuels, Gauthier & Stevens

[57] ABSTRACT

A hand tool such as a hammer is provided with an internally reinforced jacketed handle. The tool head, having an eye extending therethrough, is attached to the handle by interconnected grooves on the handle and a thermosetting material filling the grooves, an upper recess, and tapered pockets formed between the walls of the eye and the handle.

19 Claims, 4 Drawing Sheets

HAND TOOL WITH INTERNALLY REINFORCED JACKETED HANDLE

BACKGROUND OF THE INVENTION

1. Field of the Invention

This invention relates generally to hand tools, and is concerned in particular with hammers and the like having internally reinforced jacketed handles.

2. Description of the Prior Art

It has long since been known to manufacture hammers, hatchets and the like with steel handles. Such tools are disclosed, for example in U.S. Pat. Nos. 1,598,279 (Hobbs); 1,707,787 (Estwing); 2,884,969 (Lay); 3,208,724 (Vaughan); 3,320,985 (Maguire); and 4,154,273 (Pollak). While steel handles offer increased bend strength and resistance to failure, these advantages are to some extent offset by the injuries that can result in the event that the handles strike a user's hand or fingers, or come into contact with exposed electrical wiring at a construction site.

These problems have been alleviated by other so-called "jacketed" designs, where the metallic handle components are encased in softer dielectric materials, e.g., acetate, polyethylene, fiberglass and the like. Examples of these jacketed designs are shown in U.S. Pat. Nos. 2,837,381 (Sarlandt); 3,779,296 (Echeverria); and 4,738,166 (Yamaguchi).

In the prior art jacketed designs, metal-to-metal contact between coacting components provides the primary means for securing the striking heads to the handles. More particularly, in the patent to Yamaguchi, the metallic head is secured directly to the metallic reinforcing tube, presumably by force-fitting. In the Sarlandt patent, the metallic striking head is connected to what appears to be a metallic reinforcing element by means of a pin which again is presumably metallic, whereas in the patent to Echeverria, a metal wedge is forced into the upper end of the tubular metallic reinforcing element to expand the surrounding jacket against the interior of an eye extending through the striking head.

In each of these designs, the reliance on metal-to-metal contact raises the risk of the striking heads loosening under the repeated shocks and stresses accompanying normal usage.

SUMMARY OF THE INVENTION

An objective of the present invention is the provision of an improved jacketed construction which does not rely on metal-to-metal contact between coacting components in order to secure the striking head to the handle.

A companion objective of the present invention is the provision of an improved and more reliable interconnection between the internal reinforcing element and the outer jacket, as well as between the outer jacket and the striking head.

These as well as other objectives and advantages of the present invention will become more apparent as the description proceeds with reference to the accompanying drawings, wherein:

DETAILED DESCRIPTION OF ILLUSTRATED EMBODIMENTS

Figure 1:
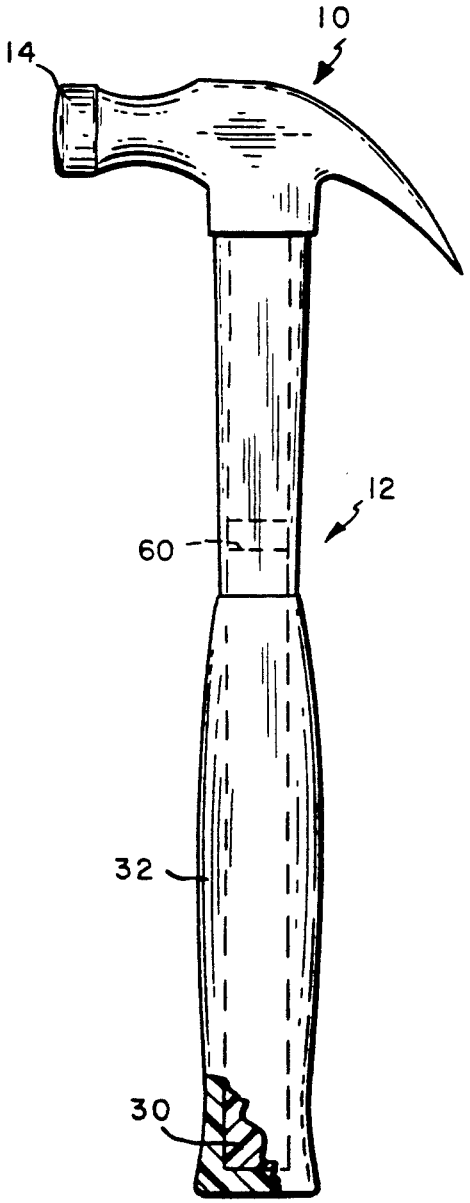
FIG. 1 is a view in side elevation of a jacketed hammer in accordance with the present invention.
Figure 2:
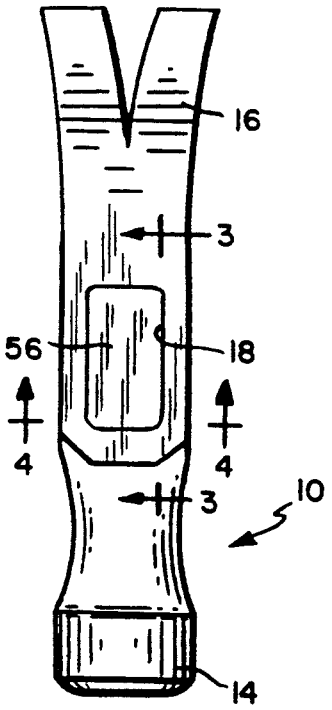
FIG. 2 is a top plan view of the hammer shown in FIG. 1.
Figure 3:
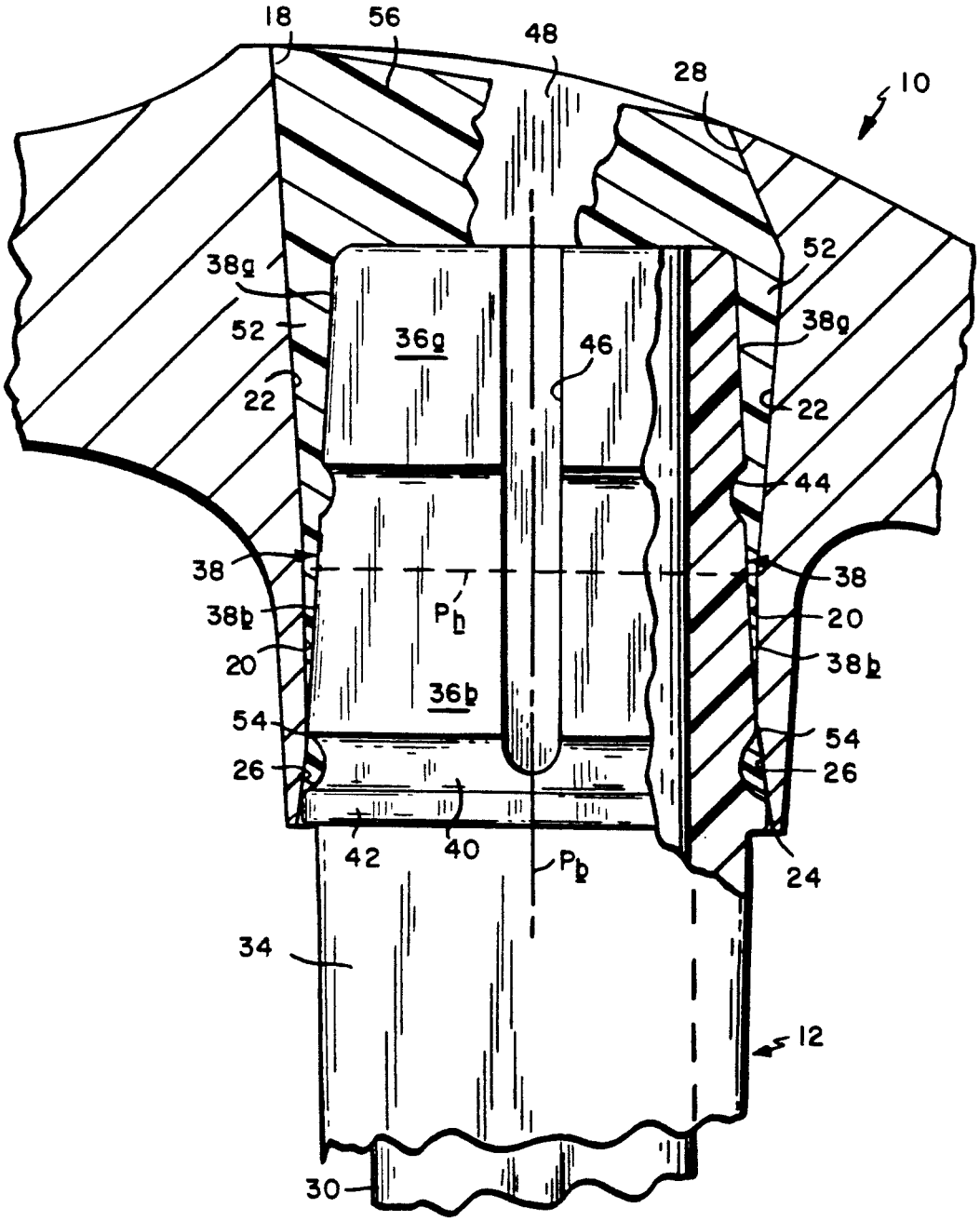

Referring now to the drawings with initial reference to FIGS. 1-3, a hand tool according to the present invention is shown comprising a striking head 10 and a handle 12. The striking head 10 may typically be that of a hammer, having an impact end 14, a claw end 16, and an eye 18 extending vertically therethrough from top to bottom. The eye is preferably of the conventional "adze" configuration, having a rectangular cross section with a lower portion defined by mutually opposed parallel walls 20, and with an upper portion defined by opposed mutually inclined walls 22 diverging outwardly with respect to each other from a horizontal reference plane $P_h$ towards the upper end of the eye. At the lower end of the eye adjacent to the bottom rim 24, the walls 20 are coined outwardly as at 26 (the degree of coining has been exaggerated for illustrative purposes in the drawings). At the upper end of the eye, the rear wall 22 has been shaped to provide an integral inwardly protruding lip 28.

The handle 12 is of the internally reinforced type, having a central core 30 of high strength material, e.g., a composite including fiberglass. The lower portion of the core element is encased in a resilient tubular grip 32 of a different material, whereas the remainder of the handle above the grip is covered by a jacket 34 molded thereon. The jacket material is preferably dielectric, and may comprise an opaque, impact modified polycarbonate/PET based injection molded resin or the like.

Figure 5:
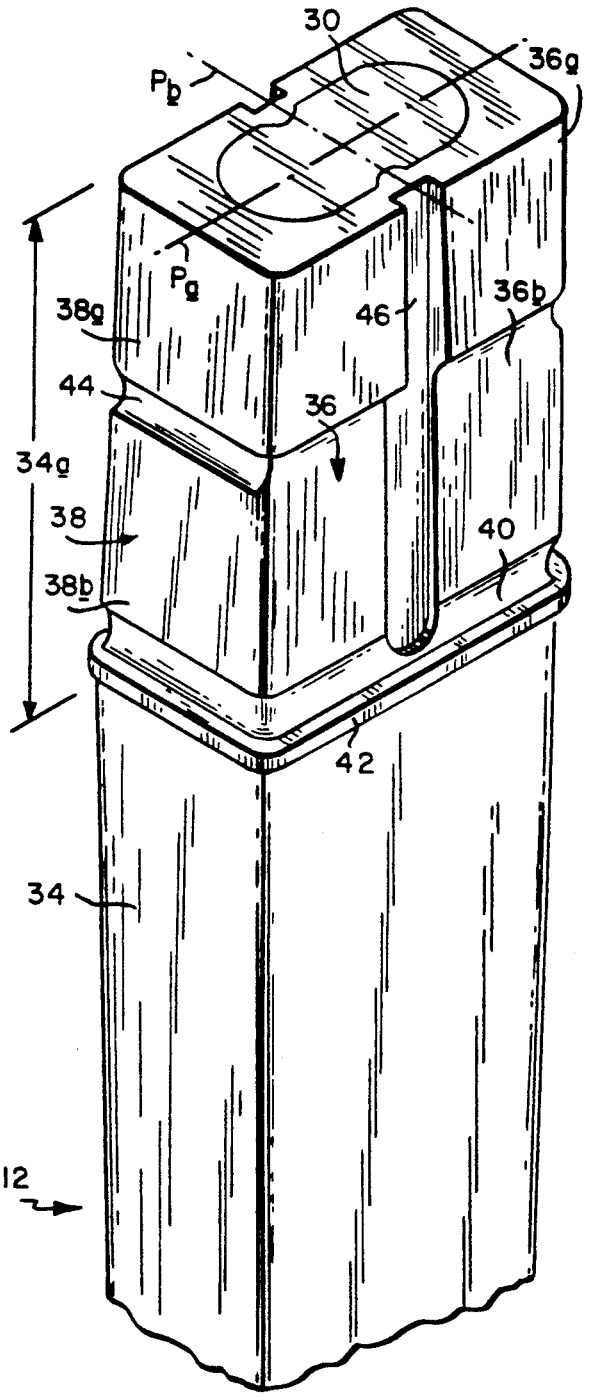
FIG. 5 is a perspective view of the upper portion of the jacketed handle prior to its insertion into the striking head.
Figure 4:
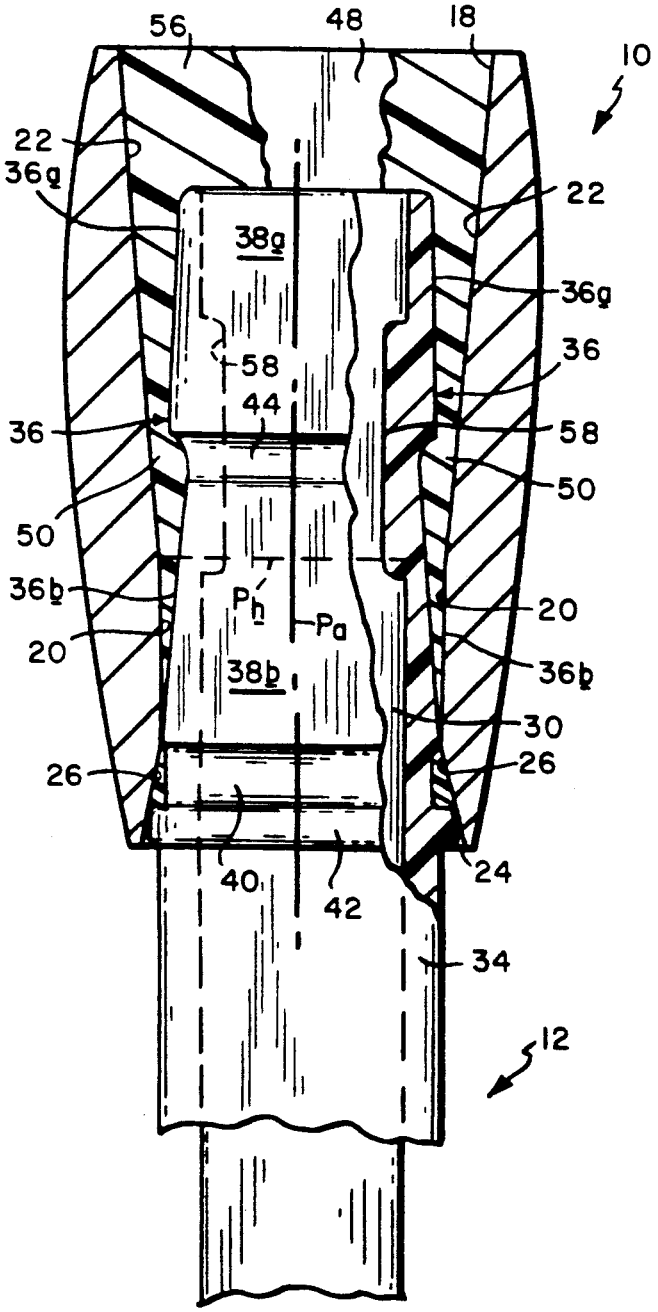
FIGS. 3 and 4 are enlarged sectional views, taken respectively along lines 3—3 and 4—4 of FIG. 2.

As can be best by additional reference to FIG. 5, the upper jacketed portion **34*a* of handle 34 is configured and dimensioned to be received in the eye 18 from the bottom thereof. Jacketed portion 34*a* has rectangular cross section arranged concentrically with respect to intersecting major and minor reference planes $P_a$, $P_b$, with side faces 36 inclined in relation to major reference plane $P_a$, and with end faces 38 inclined in relation to minor reference plane $P_b$. The side and end faces 36, 38 extend upwardly from a circumferential base groove 40 adjacent to a circumferential bottom lip 42, and are interrupted by an intermediate groove 44 spaced above the base groove 40 and below the upper end of the handle. Intermediate groove 44 subdivides the side and end faces 36, 38 into respective upper and lower segments 36*a*, 36*b* and 38*a*, 38*b*. The upper and lower segments 38*a*, 38*b* of each end face 38 lie in a common inclined plane, whereas the upper and lower segments 36*a*, 36*b* of the side faces 36** lie in parallel inclined planes and thus define a stepped configuration.

Vertical grooves 46 extend downwardly along the side faces 36 from the upper end of the handle across the intermediate groove 44 to the base groove 40. The grooves 40, 44 and 46 thus cooperate in providing an interconnected network.

When the upper jacketed portion 34*a* of the handle is inserted into the eye 18, its upper end is spaced below the top of the eye to define a recess 48. The top of the handle lies at least partially beneath the lip 28, and the exterior jacket surfaces 36, 38 cooperate in spaced relationship with the interior surfaces 20, 22 of the eye to define tapered side and end pockets 50, 52 opening towards the recess 48. The inclined surfaces 36, 38 engage the interior surfaces 20 of the eye as at 54 to thereby isolate (except for the communication provided by vertical grooves 46) the base groove 40 from the tapered pockets 50, 52. The interconnected network of surface grooves 40, 44 and 46 communicates with the upper recess 48 and with the tapered pockets 50, 52.

A thermosetting material 56, typically epoxy or the like, is introduced into the recess 48 to fill all spaces between the jacketed upper portion 34*a* of the handle and the interior surfaces of the eye 18. The material flows throughout the network of grooves 46, 44 to penetrate into the base groove 42 and the side and end pockets 50, 52, and to fill the upper recess 48. The circumferential bottom lip 42 sealingly engages the coined interior surfaces 26 of the eye to prevent leakage of the thermosetting material 56. When cured, the thermosetting material securely anchors the jacketed handle within the eye of the striking head.

The core element 30 is preferably provided with at least one and preferably two sets of milled surface slots 58, 60. The jacket material penetrates into the slot 58, 60 during molding to thereby provide an improved anchoring of the jacket on the core element. Preferably, the uppermost slots 58 underlie the intermediate groove 44.

Figure 6:
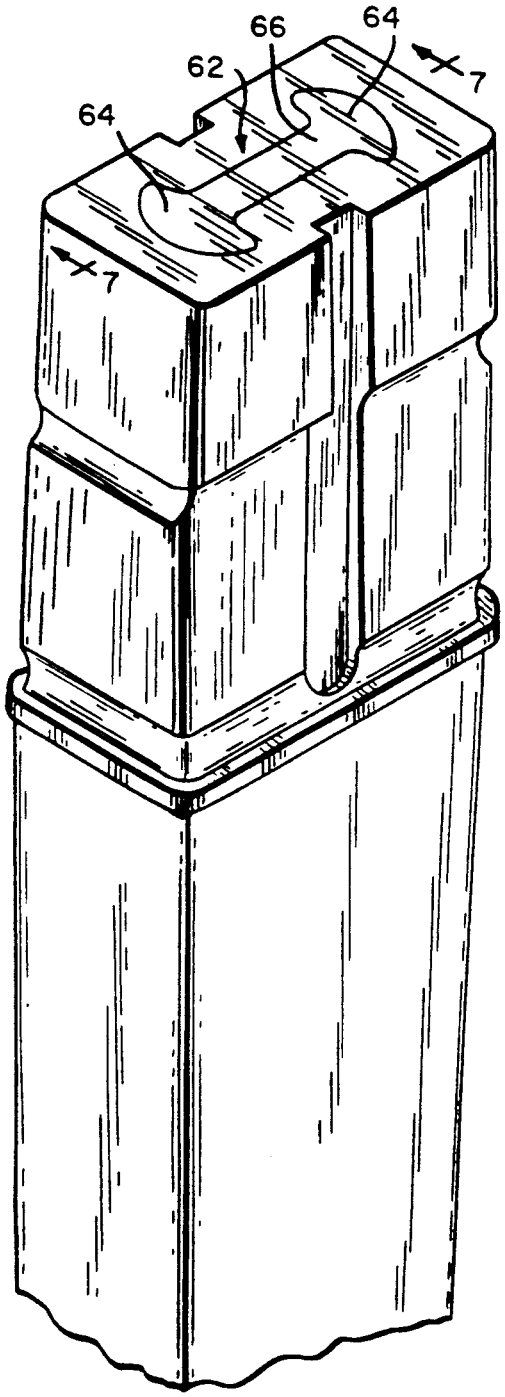
FIG. 6 is a perspective view of the upper portion of an alternate embodiment of a jacketed handle in accordance with the present invention, again prior to its insertion into the striking head.
Figure 7:
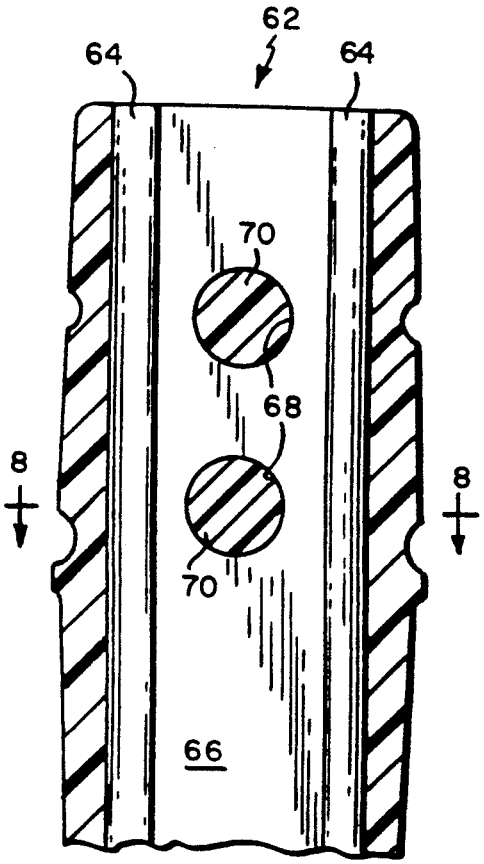
FIG. 7 is a sectional view taken along line 7—7 of FIG. 6.
Figure 8:
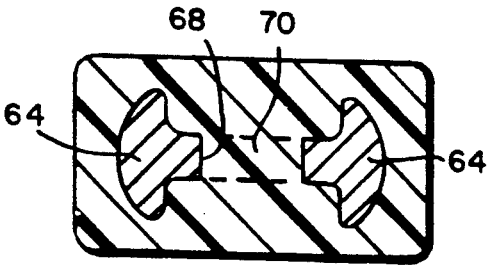
FIG. 8 is a sectional view taken along line 8—8 of FIG. 7.

FIGS. 6–8 illustrate an alternate embodiment of the invention which is identical to that disclosed in FIGS. 1–5, except that the core element is metallic, preferably comprising a steel bar 62 having a substantially I-shaped cross section with parallel side flanges 64 interconnected by a central web 66. The upper portion of the bar 62 has apertures 68 extending through the web 66. The apertures 68 are penetrated as 70 at by the jacket material to thereby provide a secure interlocked relationship.

In the light of the foregoing, it will now be appreciated by those skilled in the art that the present invention offers significant improvements and related advantages as compared to prior art jacketed handles. For example, the lip 28 extending into the eye 18 increases head security by coacting with the thermosetting material 56 to provide increased resistance to relative movement between the head and handle. The coined bottom surfaces 26 of the eye coact in improved sealing engagement with the circumferential lip 42 on the handle jacket to resist leakage of thermosetting material during the potting operation.

The milled cross slots 58, 60 in the core element 30 of the embodiment shown in FIGS. 1 to 5 aid in securely holding the jacket in place, not only during use of the tool, but also during assembly. More particularly, by positioning the uppermost cross slots 58 beneath the intermediate groove 44, increased material thickness is achieved, thereby resisting the tendency of the jacket material to fracture or tear when the handle is subjected to tension, e.g., when pulling a nail. The slots 58, 60 also resist any tendency of the jacket to "roll up" on the core element when the handle is pressed into the eye during assembly. The through apertures 68 in the web 66 of the I-beam design shown in FIGS. 5 to 8 offer many of the same advantages.

The thermosetting material in the pockets 50, 52 provides a wedge-type lock which further contributes to head retention. The interconnected network of grooves 42, 44 and 46 insures thorough penetration of the thermosetting material to all critical areas. The surface 36, 38 may, if desired, be textured in order to increase the surface area available for intimate contact with the thermosetting material.

While the invention has been disclosed in connection with claw-type hammers, it will be understood that the same features may be applicable to other types of hand tools, including for example bricklayer's hammers, scaling hammers, ball pein hammers, hatchets, etc.

I claim:

1. A hand tool comprising:

a striking head having an eye extending therethrough;

a handle having an upper portion extending into said eye from the bottom thereof, the upper end of said handle being spaced below the top of said eye to define an upper recess, said upper portion having exterior faces cooperating in spaced relationship with the interior surfaces of said eye to define tapered pockets opening towards said upper recess, said upper portion being further provided with a network of interconnected grooves extending across said exterior faces, one of said grooves being located below and isolated from said tapered pockets by contact between said exterior faces and the interior surfaces of said eye, the said one groove being connected to said tapered pockets and said upper recess via the remainder of said grooves in said network; and a thermosetting material filling said upper recess and penetrating into said tapered pockets and through said network of interconnected grooves, said thermosetting material serving to anchor the upper portion of said handle within said eye.

2. The hand tool of claim 1 wherein said striking head has a rim surrounding the bottom of said eye, and wherein the upper portion of said handle has a circumferential lip positioned below the said one groove to sealingly engage said rim and thereby prevent leakage of said thermosetting material therebetween.

3. The hand tool of claim 2 wherein said rim is coined outwardly to coact in sealing engagement with said circumferential lip.

4. The hand tool of claim 1 wherein said striking head is provided with an integral lip protruding into the top of said eye to at least partially overlie the upper end of said handle.

5. The hand tool of claim 1 wherein the upper portion of said handle has a rectangular cross section arranged concentrically with respect to intersecting major and minor reference planes, with oppositely facing pairs of said exterior faces being angularly disposed in relation to respective ones of said reference planes.

6. The hand tool of claim 1 wherein said network of interconnected grooves includes a circumferential intermediate groove subdividing said exterior faces into upper and lower segments.

7. The hand tool of claim 6 wherein at least some of said faces have their respective segments arranged in the same plane.

8. The hand tool of claim 6 wherein at least some of said faces have their respective segments arranged in parallel planes.

9. The hand tool as claimed in any one of claims 1–8 wherein said handle is comprised of an elongate core element of a first material having upper and lower sections, said upper section having a jacket of a second material molded thereon and forming said upper portion, said lower section being encased within a tubular grip of a third material.

10. The hand tool of claim 9 wherein said first material is a composite including fiberglass.

11. The hand tool of claim 10 wherein said upper section is provided with at least two sets of oppositely facing surface slots spaced along the length thereof, the second material of said jacket penetrating into and interlocking with said slots.

12. The hand tool of claim 11 wherein one of said sets of slots is located within said upper portion.

13. The hand tool of claim 12 wherein the said one set of slots underlies the grooves extending across said exterior faces.

14. The hand tool of claim 9 wherein said second material is an opaque, impactmodified polycarbonate/-PET-based injection molding resin.

15. The hand tool of claim 9 wherein said core element is a steel bar.

16. The hand tool of claim 15 wherein said steel bar has parallel flanges interconnected by a central web to define a substantially I-shaped cross section.

17. The hand tool of claim 16 wherein said central web has apertures therein at said upper portion, the second material of said jacket penetrating into and interlocking with said apertures.

18. A hand tool comprising:

a striking head having a contoured top surface and an eye extending therethrough from a rectangular top opening in said top surface to a bottom opening;

a lip formed integrally with said head and protruding in cantilever fashion beneath the contour of said top surface and into said eye from one side only of said top opening;

a handle having an upper portion extending into said eye through said bottom opening, the upper end of said handle partially underlying said lip and being spaced below the top opening of said eye to define an upper recess, said upper portion having exterior faces cooperating in spaced relationship with the interior surfaces of said eye to define tapered pockets opening towards said upper recess; and a thermosetting material filling said upper recess and penetrating into said tapered pockets, said thermosetting material serving to anchor the upper portion of said handle within said eye.

19. A hand tool comprising:

a striking head having an eye extending therethrough;

a handle having an upper portion extending into said eye from the bottom thereof, the upper end of said handle being spaced below the top of said eye to define an upper recess, said upper portion having exterior faces cooperating in spaced relationship with the interior surfaces of said eye to define tapered pockets opening towards said upper recess, said upper portion being further provided with a network of interconnected grooves communicating with said upper recess and extending across said exterior faces, one of said grooves being arranged to circumferentially subdivide said exterior faces into upper and lower segments, at least some of said faces having their respective upper and lower segments lying in parallel planes; and a thermosetting material filling said upper recess and penetrating into said tapered pockets and through said network of interconnected grooves, said thermosetting material serving to anchor the upper portion of said handle within said eye.

* * * * *